United States Patent [19]

Rosenberg et al.

[11] 3,973,097

[45] Aug. 3, 1976

[54] CONTROL DEVICE HAVING LOCKING SELECTOR MEANS

[75] Inventors: David M. Rosenberg; John W. Stearley, both of Indiana, Pa.

[73] Assignee: Robertshaw Controls Company, Richmond, Va.

[22] Filed: July 15, 1974

[21] Appl. No.: 488,303

[52] U.S. Cl. ..... 200/153 L; 200/11 R; 200/327

[51] Int. Cl.² ..... H01H 19/58

[58] Field of Search..... 200/153 R, 153 L, 153 LA, 200/153 LB, 155 R, 327, 336, 323–325, 11 R, 318; 338/122, 198

[56] References Cited

UNITED STATES PATENTS

| | | | |
|---|---|---|---|
| 2,498,651 | 2/1950 | Crom | 200/11 R X |
| 3,359,392 | 12/1967 | Heath | 200/153 L |

*Primary Examiner*—Herman J. Hohauser
*Attorney, Agent, or Firm*—Candor, Candor & Tassone

[57] ABSTRACT

A control device having a housing provided with a movable actuator and a rotatable selector shaft for positioning the actuator in relation to the rotational position of the shaft. An actuator driver is carried by the shaft and is operatively interconnected to the actuator to drive the same upon rotation of the driver by the shaft, the shaft and driver being axially movable relative to the actuator. The housing has a latching part cooperable with a latching part of the driver when the shaft is in a certain rotational and axial position relative to the housing whereby the shaft cannot be rotated relative to the housing until the shaft is axially moved from that certain axial position thereof to another axial position thereof to clear the latching part of the driver from the latching part of the housing and thereby unlock the selector shaft.

11 Claims, 9 Drawing Figures

CONTROL DEVICE HAVING LOCKING SELECTOR MEANS

This invention relates to an improved selector means of a control device.

It is well known that various control devices have each been provided with a rotatable selector shaft for turning on and off the control device or for selectively determining the operating condition of the control device or the like.

It is a feature of this invention to provide an improved means for locking a selector shaft of such a control device in its "off" position and thereby requiring unlocking of such selector shaft before the same can be turned to an "on" position thereof whereby a safety feature is provided by this invention in that the same prevents the control device from being accidentally turned to an "on" condition thereof.

In particular, this invention provides a control device having a housing provided with a movable actuator and a rotatable selector shaft for positioning the actuator in relation to the rotational position of the shaft. An actuator driver is carried by the shaft and is operatively interconnected to the actuator to drive the same upon rotation of the driver by the shaft, the shaft and driver being axially movable relative to the actuator. The housing has a latching means and the driver has a latching means cooperable with the latching means of the housing when the shaft is in a certain rotational and axial position relative to the housing whereby the shaft cannot be rotated relative to the housing until the shaft is axially moved from that certain axial position thereof to another axial position thereof to clear the latching means of the driver from the latching means from the housing and thereby unlock the selector shaft. The certain axial and rotational position of the selector shaft can be the "off" position of the selector shaft and the actuator can comprise a cam for operating an electrical switch disposed in the housing of the control device.

Accordingly, it is an object of this invention to provide an improved control device having one or more of the novel features set forth above or hereinafter shown or described.

Other objects, uses and advantages of this invention are apparent from a reading of this description which proceeds with reference to the accompanying drawings forming a part thereof and wherein.

Figure 1:
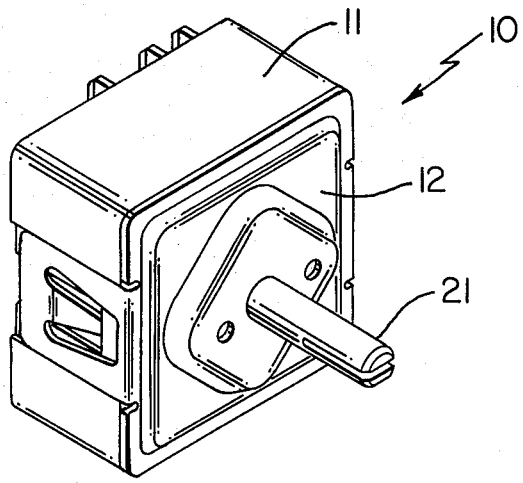
FIG. 1 is a perspective view of the improved control device of this invention.

While the various features of this invention are hereinafter illustrated and described as being particularly adaptable to provide a control device having an electrical switch means therein, it is to be understood that the various features of this invention can be utilized singly or in any combination thereof to provide selector means for other types of control devices as desired.

Therefore, this invention is not to be limited to only the embodiments illustrated in the drawings, because the drawings are merely utilized to illustrate one of the wide variety of uses of this invention.

Figure 2:
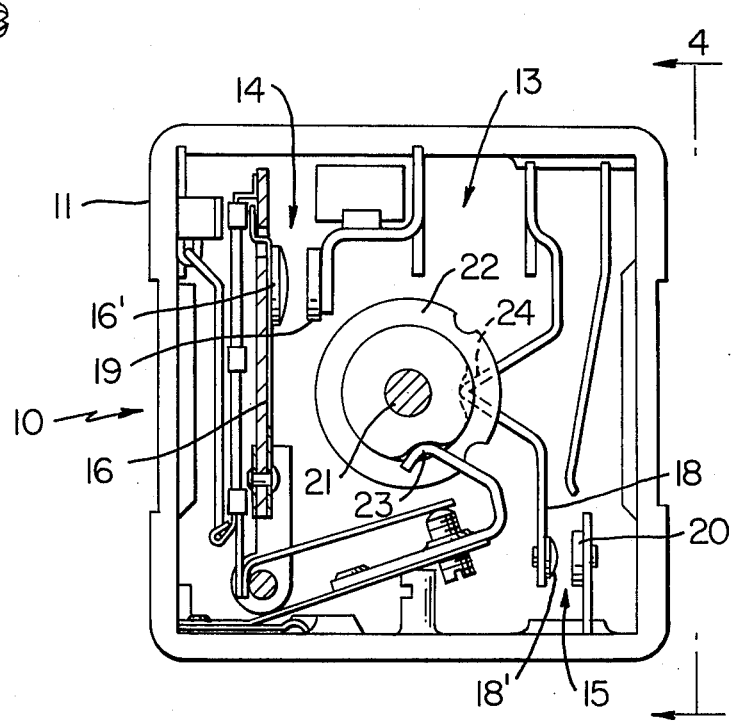
FIG. 2 is an enlarged front view of the control device of FIG. 1 with the cover member removed and with the control device in the "off" position thereof.
Figure 3:
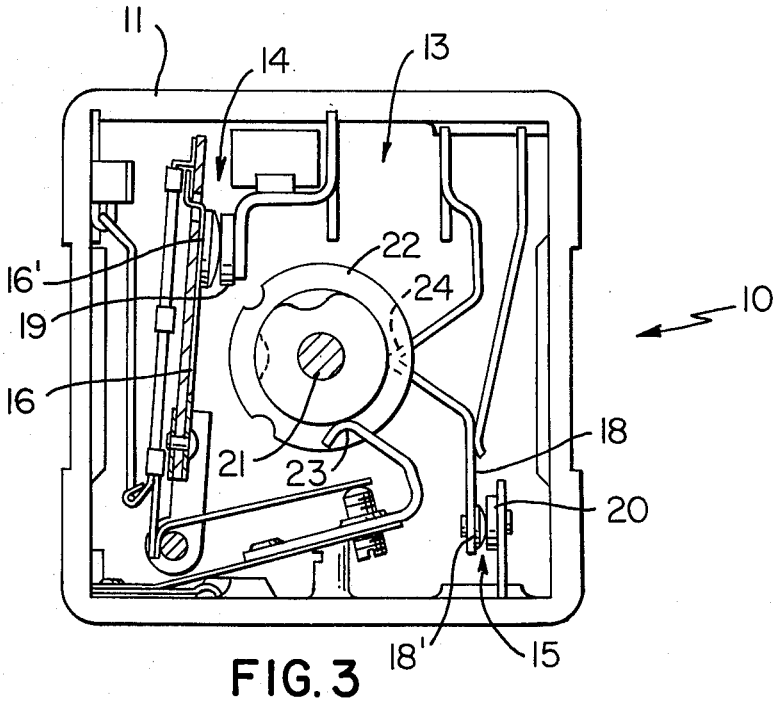
FIG. 3 is a view similar to FIG. 2 and illustrates the control device in an "on" condition thereof.
Figure 4:
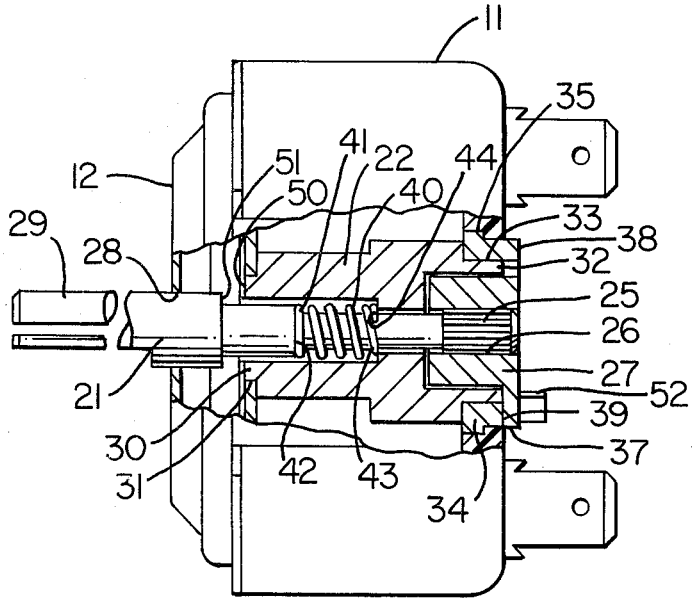
FIG. 4 is a side view of the control device of FIG. 1 and is taken substantially in the direction of the arrows 4—4 of FIG. 2 with a part of the control device being broken away.
Figure 6:
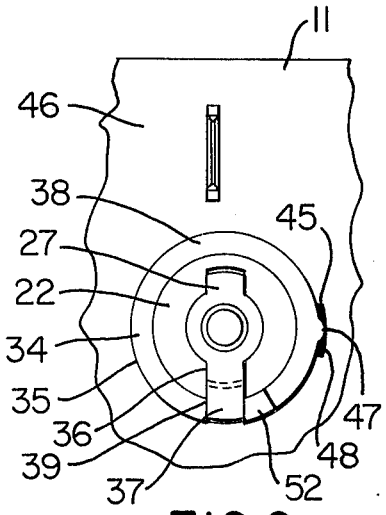
FIG. 6 is a fragmentary rear view of the control device of FIG. 4.

Referring now to FIGS. 1, 2 and 3, the improved control device of this invention is generally indicated by the reference numeral 10 and comprises a housing means 11 provided with a front cover 12 and defining a chamber 13 therein, the control device 10 having one or more electrical switches 14 and 15 disposed in chamber 13 and respectively comprising movable switch blades 16 and 18 normally having their respective contacts 16′ and 18′ held out of contact with fixed contacts 19 and 20 when a selector shaft 21 of the control device 10 is disposed in the "off" position illustrated in FIGS. 2, 4 and 6.

Figure 5:
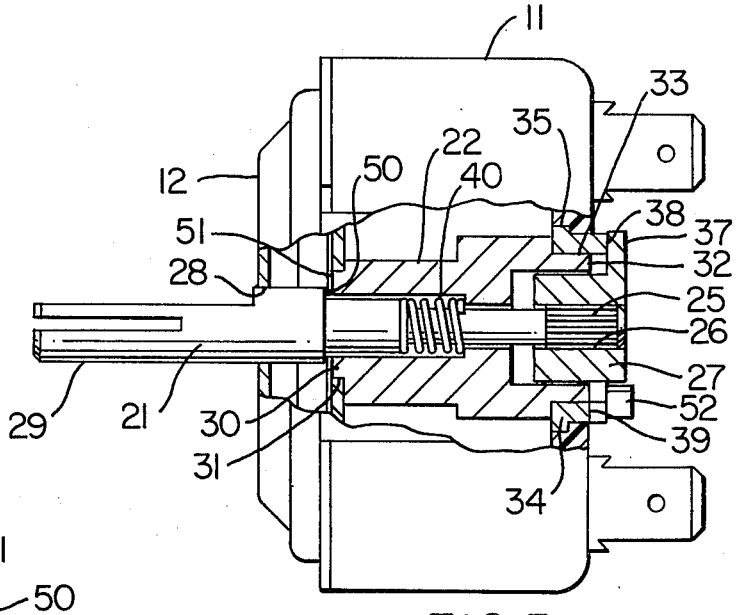
FIG. 5 is a view similar to FIG. 4 and illustrates the control device in an "on" condition thereof.
Figure 7:
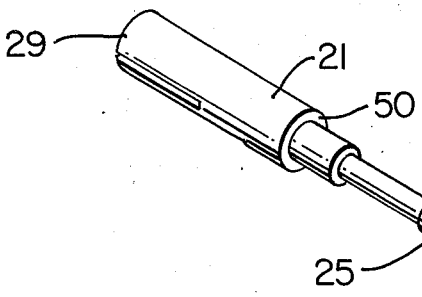
FIG. 7 is an exploded perspective view of certain parts of the selector means of the control device of FIG. 1.
Figure 7:
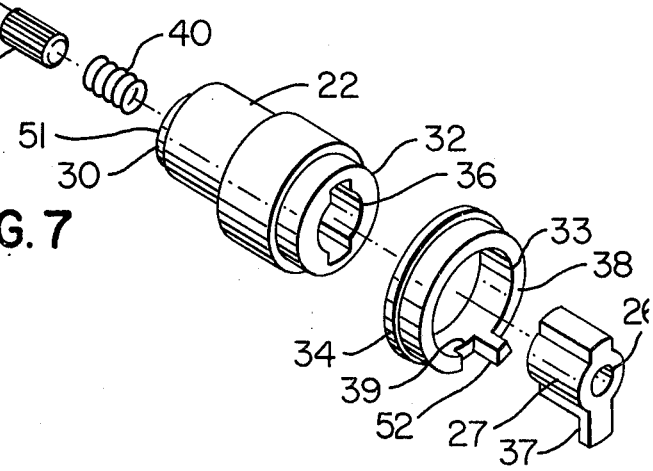

However, the selector shaft 21 is operatively interconnected to an actuator cam 22 in an manner hereinafter described so that when the shaft 21 is turned to an "on" position thereof as illustrated in FIGS. 3 and 5, the actuator cam 22 has been rotated relative to the housing 11 so that appropriate cam surfaces thereof operate on cam follower portions 23 and 24 of the respective switch blades 16 and 18 to move their respective contacts 16′ and 18′ into contact with the fixed contacts 19 and 20 as illustrated in FIG. 3 for any desired control purpose.

As previously stated, one of the features of this invention is to provide a safety locking means for the selector shaft 21 so that when the same is disposed in the "off" position of FIGS. 2 and 4, the shaft 21 cannot be accidentally rotated from that "off" position to the "on" position of FIGS. 3 and 5 unless the control shaft 21 is unlocked from its "off" position.

In particular, as best illustrated in FIGS. 4–7, the control shaft 21 is provided with a knurled end 25 to be press fitted into a bore 26 of an actuator driver 27 whereby the actuator driver 27 is fixed to the shaft 21 and is rotatable in unison with the shaft 21, the shaft 21 passing through an opening 28 in the front cover 12 to rotatably support the left-hand end 29 of the shaft 21 in FIG. 4 while the cam driver 27 is utilized to rotatably mount the right-hand end 25 thereof as will be apparent hereinafter.

The actuator cam 22 has one end 30 rotatably mounted in a bearing opening 31 of the housing means 11 and the other end 32 thereof disposed in a bearing opening 33 of a ring member 34 carried in a stepped bore 35 of the housing 11 and fastened thereto in a manner hereinafter described whereby the cam actuator 22 is rotatably mounted to the housing means 11.

The end 32 of the cam actuator 22 has a key-way opening 36 formed therein to receive the cam driver 27 therein so as to spline the same together whereby the actuator driver 27 is axially movable relative to the cam actuator 22, but will rotate in unison therewith as will be apparent hereinafter.

The actuator driver 27 has an outwardly directed tang 37 which is adapted to engage against an annular bearing surface 38 of the ring member 34 as well as be receivable in a cooperating recess 39 formed in the annular surface 38 for a purpose hereinafter described.

A compression spring 40 is telescoped on the selector shaft 21 and has one end 41 bearing against an annular shoulder 42 of the shaft 21 and the other end 43 thereof bearing against an annular shoulder 44 of the cam actuator 22 in the manner illustrated in FIG. 4 whereby the force of the compression spring 40 normally tends to maintain the selector shaft 21 in a leftward direction relative to the housing 11 so that the same will tend to maintain the tang 37 of the cam driver 27 against the annular surface 38 of the ring member 34 while permitting sliding movement therebetween or to move the tang 37 of the cam driver 27 into the recess 39 in the manner illustrated in FIGS. 4 and 6 when the selector shaft 21 is disposed in its "off" position.

In order to orient the recess 39 of the ring member 34 in the proper position for receiving the tang 37 of the actuator driver 27 when the shaft 21 is disposed in its "off" position, the ring member 34 is initially assembled in the stepped bore 35 of the housing 11 without being secured thereto so that the ring member 34 can be rotated to the desired position for locating the recess 39 in the proper position for the "off" position of the shaft 21. When the ring member 34 is so positioned a suitable epoxy resin 48 can be received in a cavity 45 formed in the rear surface 46 of the housing 11 adjacent the stepped bore 35 thereof and the ring member 34 can have an outwardly directed locking projection 47 formed therein which is also disposed in the recess 45 so that when the epoxy resin 48 subsequently hardens, the same locks the ring member 34 in the desired rotational position thereof.

Thus, it can be seen that the control device 10 of this invention can be formed of a relatively few simple parts to operate in a manner now to be described.

When the selector shaft 21 is disposed in the "off" position as illustrated in FIGS. 2, 4 and 6, the tang 37 of the actuator driver 27 is oriented with the recess 39 of the ring member 34 so that the shaft 21 has been axially moved by the spring 40 towards the same into its fully left-hand position as illustrated in FIG. 4 whereby the control shaft 21 is in a certain rotational and axial position relative to the housing means 11 so that the same cannot be rotated in that axial position thereof as the tang 37 of the driver 27 is fully locked in the recess 39 of the ring member 34.

In this "off" position of the control shaft 21, it can readily be seen in FIG. 2 that the cam actuator 22 is maintaining the switches 14 and 15 in an open condition thereof.

Therefore, a person cannot accidentally rotate the shaft 21 by bumping the same or the conventional control knob disposed thereon to turn the control device 10 "on" by the accidental closing of the switches 14 and 15 thereof because in order for a person to turn the control device 10 to an "on" position, the person must grasp the shaft 21 and axially move the same to the right in FIG. 4 in opposition to the force of the compression spring 40 until the tang 37 of the driver 27 is completely moved out of the recess 39 of the ring member 34 to permit the shaft 21 to be rotated relative thereto.

If desired, the control shaft 21 can be provided with an annular shoulder 50 which is adapted to abut against the end 51 of the actuator 22 in the manner illustrated in FIG. 5 when the shaft 21 has been moved inwardly a sufficient distance to have the tang 37 of the driver 27 clear the recess 39 so that the operator now knows that he is free to turn the shaft 21 to the desired "on" position thereof to cause closing of the switches 14 and 15 in the manner illustrated in FIG. 3. Such rotational movement of the shaft 21 is accomplished even though the shaft 21 is no longer held in the "in" condition illustrated in FIG. 5 once the tang 37 of the driver 27 has been rotated beyond a position for being received in the recess 39 whereby the force of the compression spring 40 will only move the tang 37 against the annular bearing surface 38 of the ring member 34 while permitting sliding movement therebetween as the shaft 21 is rotated to the desired "on" position thereof.

Thereafter, when an operator desires to turn off the control device 10, the shaft 21 is merely rotated to the "off" position thereof whereby the compression spring 40 will drive the shaft 21 and driver 27 to the left in FIG. 5 to permit the tang 37 to enter the recess 39 and again lock the shaft 21 in the "off" position thereof as illustrated in FIG. 4.

If desired, the ring member 34 can be provided with an outwardly directed stop tang 52 against which the driver tang 37 will abut when the shaft 21 is in its "off" position to thereby orient the tang 37 of the driver 27 with the recess 39 in the ring member 34. Also, when the shaft 21 is being rotated in its "on" condition, the other side of the stop tang 52 will prevent the driver tang 37 from being rotated in the "on" direction of the shaft 21 to a position where it will automatically move into the recess 39. Thus, the shaft 21 must be rotated in the "off" direction in order to align the driver tang 37 with the recess 39.

Figure 8:
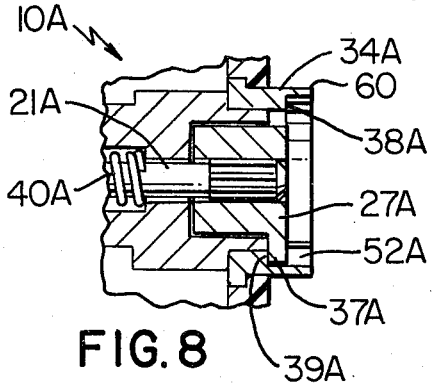
FIG. 8 is a fragmentary view similar to FIG. 4 and illustrates another embodiment of the control device of this invention.
Figure 9:
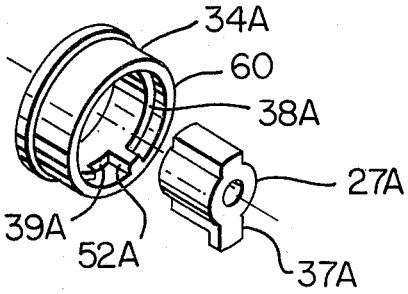
FIG. 9 is an exploded perspective view of part of the selector means of the control device of FIG. 8.

Another control device of this invention is generally indicated by the reference numeral 10A in FIGS. 8 and 9 and parts thereof similar to like parts of the control device 10 of FIGS. 1–7 are indicated by like reference numerals followed by the reference letter "A".

The control device 10A is substantially identical to the control device 10 previously described except that the ring member 34A thereof has a tubular extension 60 extending outwardly beyond the bearing surface 38A thereof for confining and guiding movement of the tang 37A of the driver 27A during the rotation of the selector shaft 21A for the purposes previously described.

The tubular extension 60 of the ring member 34A has integral therewith a stop projection 52A extending inwardly therefrom and disposed over the bearing surface 38A in the manner illustrated in FIGS. 8 and 9 to limit rotational movement of the driver 27A by having the tang 37A thereof engaged against one side of the stop member 52A when the tang 37A is aligned with the recess 39A that is formed in the bearing surface 38A and is in the "off" position of the selector shaft 21A. The tang 37A abuts against the other side of the stop 52A which limits the rotational movement of the driver 27A in the "on" direction thereof in the same manner as the stop 52 of the control device 10.

Thus, it can be seen that when the control device 10A is to be turned from the "off" position illustrated in FIG. 8, the selector shaft 21A is axially moved to the right in opposition to the force of the compression spring 40A until the tang 37A of the driver 27A clears the recess 39A. At this time, the selector shaft 21A can be rotated as the tang 37A can now engage and slide against the bearing surface 38A as previously described.

The length of the extension 60 of the ring member 34A is such that when the control shaft 21A has the shoulder thereof (not shown) bottoming out against the control device in the manner previously described for the control device 10, the tang 37A and actuator 27A have not been moved to the right sufficiently to project out of the tubular member 60 so that the tang 37A and driver 27A are fully protected by the extension 60 even though the shaft 21A has been axially moved to the right to its greatest distance in the manner previously described. Thus, the extension 60 fully protects and guides movement of the tang 37A, as well as the driver 27A, in all of the operating positions thereof.

When it is desired to turn off the control device 10A, the selector shaft 21A is rotated in the proper direction until the tang 37A aligns with the recess 39A so that the force of the compression spring 40A can move the shaft 21A to the left in the drawings and cause the tang 37A to enter the recess 39A in the manner illustrated in FIG. 8 to lock the shaft 21A in the rotational and axial position illustrated in FIG. 8, which position corresponds to the "off" position of the selector shaft 21A for the reasons previously set forth.

Therefore, it can be seen that this invention provides an improved selector means for a control device or the like.

While the forms of this invention now preferred have been described and illustrated as required by the Patent Statute, it is to be understood that other forms can be utilized and still come within the scope of the appended claims.

What is claimed is:

1. In a control device having a housing provided with a movable actuator and a rotatable selector shaft for positioning said actuator in relation to the rotational position of said shaft, said shaft extending out of the front of said housing and extending through said actuator to the rear of said housing, the improvement comprising an actuator driver telescopically carried by said shaft at the rear of said housing and being operatively interconnected to said actuator to drive the same upon rotation of said driver by said shaft, said shaft and driver being axially movable relative to said actuator, said housing having a latching means, said driver having a latching means cooperable with said latching means of said housing when said shaft is in a certain rotational and axial position relative to said housing whereby said shaft can not be rotated relative to said housing until said shaft is axially moved from said certain axial position to another axial position to clear said latching means of said driver from said latching means of said housing.

2. In a control device as set forth in claim 1, said latching means of said housing comprising a recess.

3. In a control device as set forth in claim 2, said latching means of said driver comprising a tang receivable in said recess to lock said shaft in said certain rotational and axial position.

4. In a control device as set forth in claim 3, said housing having a spring means operatively associated with said shaft to tend to move said shaft to said certain axial position thereof.

5. In a control device as set forth in claim 4, said housing having a bearing surface against which said tang of said driver can engage and slide thereon as said shaft is rotated in said other axial position thereof so that said spring means cannot move said shaft to said certain axial position thereof.

6. In a control device as set forth in claim 5, said bearing surface comprising a ring member carried by said housing.

7. In a control device as set forth in claim 6, said ring member having a tubular extension which guides said sliding movement of said tang of said driver.

8. In a control device as set forth in claim 6, said ring member having another bearing surface rotatably mounting said actuator to said housing.

9. In a control device as set forth in claim 6, said ring member being initially rotatable relative to said housing, and means locking said ring member in a selected rotational position relative to said housing.

10. In a control device as set forth in claim 1, said actuator comprising a cam.

11. In a control device as set forth in claim 10, an electrical switch carried by said housing and being operatively associated with said cam to be operated thereby.

* * * * *